US008923745B2

(12) United States Patent
Tano et al.

(10) Patent No.: US 8,923,745 B2
(45) Date of Patent: Dec. 30, 2014

(54) CLEANING BLADE, CLEANING DEVICE, PROCESS CARTRIDGE, AND IMAGE FORMING APPARATUS

(71) Applicant: Fuji Xerox Co., Ltd., Tokyo (JP)

(72) Inventors: Daisuke Tano, Kanagawa (JP); Masato Ono, Kanagawa (JP); Tsutomu Sugimoto, Kangawa (JP); Noriaki Kojima, Kanagawa (JP); Yoshinori Takahashi, Kanagawa (JP); Kei Tanaka, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/030,513

(22) Filed: Sep. 18, 2013

(65) Prior Publication Data

US 2014/0255070 A1 Sep. 11, 2014

(30) Foreign Application Priority Data

Mar. 8, 2013 (JP) ..... 2013-047297

(51) Int. Cl.
*G03G 21/00* (2006.01)

(52) U.S. Cl.
CPC ..... *G03G 21/0017* (2013.01); *G03G 21/0011* (2013.01)
USPC ..... 399/350; 430/119.84

(58) Field of Classification Search
CPC ..... G03G 21/0011; G03G 21/0017
USPC ..... 399/343, 350
See application file for complete search history.

(56) References Cited

U.S. PATENT DOCUMENTS

| | | | | |
|---|---|---|---|---|
| 8,787,813 | B2 * | 7/2014 | Tano et al. | 399/350 |
| 2005/0260014 | A1 * | 11/2005 | Nakano et al. | 399/284 |
| 2006/0216084 | A1 * | 9/2006 | Kojima et al. | 399/350 |
| 2009/0003905 | A1 * | 1/2009 | Ueno et al. | 399/350 |

FOREIGN PATENT DOCUMENTS

| | | |
|---|---|---|
| JP | A-5-119676 | 5/1993 |
| JP | A-2010-134111 | 6/2010 |

* cited by examiner

*Primary Examiner* — Benjamin Schmitt
(74) *Attorney, Agent, or Firm* — Oliff PLC

(57) ABSTRACT

A cleaning blade includes a contact portion that contacts a member to be cleaned, and the contact portion at least contains polyurethane rubber and has at least two different endothermic peak temperatures by differential scanning calorimetry in a range of 100° C. or higher.

17 Claims, 5 Drawing Sheets

CLEANING BLADE, CLEANING DEVICE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2013-047297 filed Mar. 8, 2013.

BACKGROUND

1. Technical Field

The present invention relates to a cleaning blade, a cleaning device, a process cartridge, and an image forming apparatus.

2. Related Art

In the related art, in a copying machine, a printer, a facsimile and the like of an electrophotographic system, a cleaning blade has been used as a cleaning unit for removing remaining toner or the like on a surface of an image holding member such as a photoreceptor.

SUMMARY

According to an aspect of the invention, there is provided a cleaning blade including a contact portion that contacts a member to be cleaned, wherein the contact portion at least contains polyurethane rubber and has at least two different endothermic peak temperatures by differential scanning calorimetry in a range of 100° C. or higher.

BRIEF DESCRIPTION OF THE DRAWINGS

Exemplary embodiments of the present invention will be described in detail based on the following figures, wherein.

DETAILED DESCRIPTION

Figure 1:
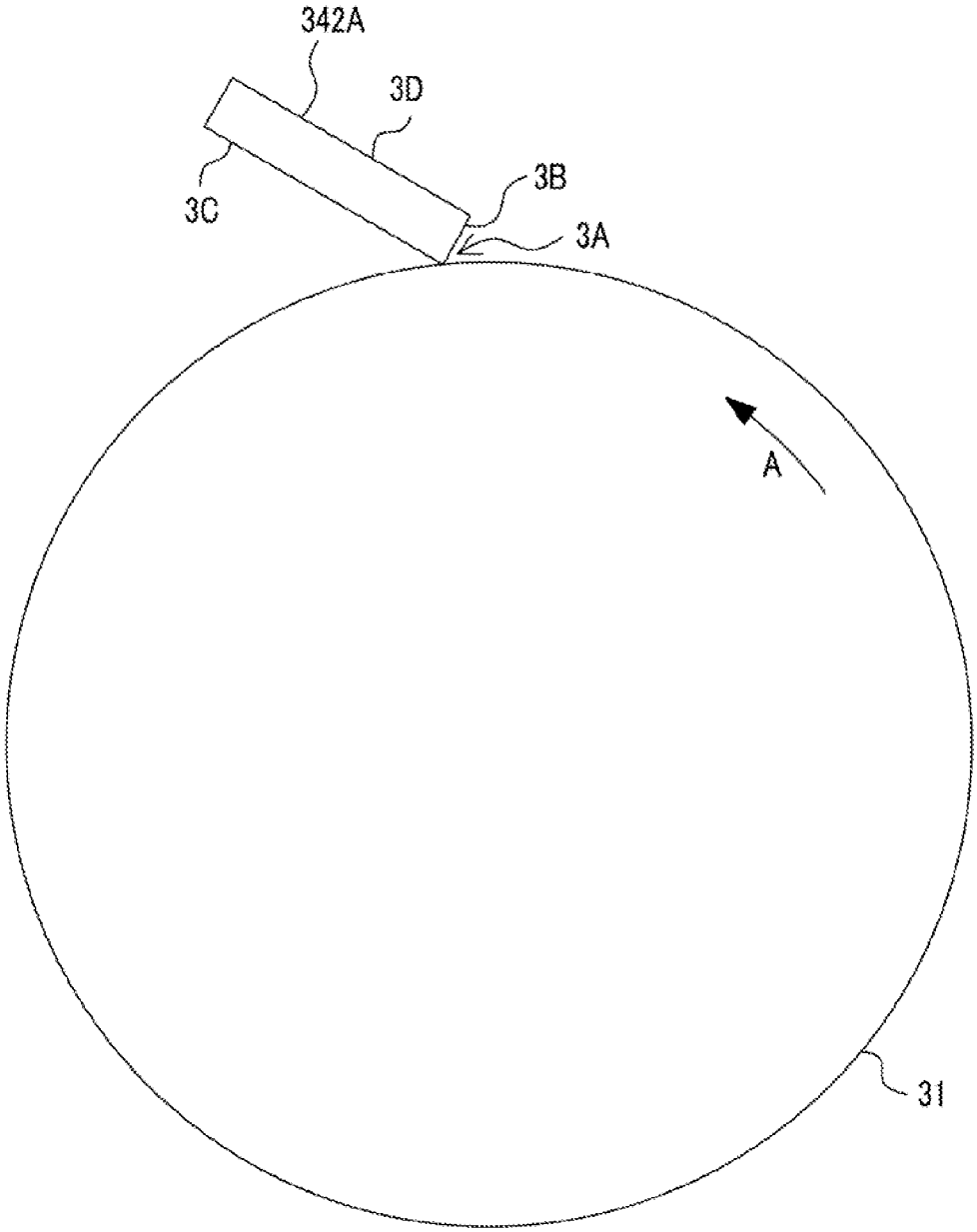
FIG. 1 is a schematic view showing an example of a cleaning blade of an exemplary embodiment.

Hereinafter, exemplary embodiments of a cleaning blade, a cleaning device, a process cartridge, and an image forming apparatus of the invention will be described in detail.

Cleaning Blade

A cleaning blade according to the exemplary embodiment contains a contact portion that contacts a member to be cleaned, and the contact portion contains polyurethane and has at least two different endothermic peak temperatures by differential scanning calorimetry in a range of 100° C. or higher.

Since the cleaning blade used for an image forming apparatus or the like slides while contacting a member to be cleaned (image holding member or the like), the contacting portion gradually abraded, and the lifetime of the cleaning blade changes depending on the degree of the abrasion. Accordingly, an abrasion resistance property is required from a viewpoint of high durability. However, a rubber property (strength) required is not obtained when applying abrasion resistance to the cleaning blade, and as a result, cracks on the portion of the blade which comes in contact with the member to be cleaned (image holding member or the like) occur due to repeated use, in some cases. That is, it is difficult to satisfy both the abrasion resistance property and the strength.

In contrast, the cleaning blade according to the exemplary embodiment includes a polyurethane rubber member having at least two different endothermic peak temperatures by the differential scanning calorimetry at least on a portion which comes in contact with the member to be cleaned, and thus, both an excellent abrasion resistance property and high strength are satisfied.

It is considered that these effects are obtained by the following reasons.

To include two different endothermic peak temperatures by the differential scanning calorimetry means that there is a mixture of the hard segment aggregates (crystal portions) on a high melting point side and the hard segment aggregates (crystal portions) on a low melting point side in the hard segment of the polyurethane rubber. In addition, the hard segment aggregates (crystal portions) on a high melting point side have a relatively large particle size of the crystal sphere, and the hard segment aggregates (crystal portions) on a low melting point side have a relatively small particle size of the crystal sphere.

It is considered that, by providing the crystals having a high melting point (large particle size) on the contacting portion of the cleaning blade, a sliding property is given and the abrasion resistance property is improved. On the other hand, since the crystal portions having a low melting point (small particle size) have a large surface area joined with the soft segment, it is considered that higher strength and higher durability are obtained and crack resistance property is improved.

That is, the large crystal portions on a high melting point side and the small crystal portions on a low melting point side exist in the hard segment of the polyurethane rubber, by providing at least two different endothermic peak temperatures, and with the two crystal portions, functional separation is realized and a cleaning blade satisfying both high abrasion resistance property and high strength is obtained.

In the related art, from a viewpoint of decreasing of friction on a contacting portion of the cleaning blade, a lubricant such as zinc stearate is applied to the contacting portion, however, in the cleaning blade according to the exemplary embodiment, cleaning is performed with decreased usage of the lubricant or without using the lubricant. Accordingly, contamination due to the attachment of the lubricant may also be suppressed.

For a method of controlling to have at least two endothermic peak temperatures (melting temperatures), first, speed of primary curing is increased by using a catalyst having excellent reactivity and chemical crosslink is proceeded by the primary curing, and accordingly, a cleaning blade shape is formed and crystal portions having a small particle size are controlled. Then, in secondary curing, a method of setting an aging time longer by setting a polymerization temperature lower at the time of polymerization to have an environment in that physical crosslink is easily proceeded, and generating crystal portions having a large particle size is used.

The controlling method described above will be described later in detail.

Particle Size of Hard Segment Aggregates

In the exemplary embodiment, the polyurethane rubber includes the hard segment and the soft segment, and the hard segment includes the hard segment aggregates having a relatively large particle size and a high melting point, and the hard segment aggregates having a relatively small particle size and a low melting point.

An average particle size of the hard segment aggregates on a high melting point side (having a large particle size) is preferably from 5 μm to 20 μm, and more preferably from 5 μm to 15 μm, and even more preferably from 5 μm to 10 μm.

By setting the average particle size of the hard segment aggregates on a high melting point side (having a large particle size) to be equal to or more than 5 μm, a crystal area on a blade surface is increased and the sliding property is improved. On the other hand, by setting the average particle size thereof to be equal to or less than 20 μm, the decreased friction is maintained and toughness (crack resistance) is not lost.

Meanwhile, an average particle size of the hard segment aggregates on a low melting point side (having a small particle size) is preferably from 0.10 μm to 0.50 μm, and more preferably from 0.10 μm to 0.30 μm, and even more preferably from 0.10 μm to 0.20 μm.

By setting the average particle size, of the hard segment aggregates on a low melting point side (having a small particle size) to be equal to or more than 0.10 μm, the increased strength is maintained and the sliding property is not lost. On the other hand, by setting the average particle size thereof to be equal to or less than 0.50 μm, since the surface area joined with the soft segment is large, the strength is further increased.

The average particle size of the hard segment aggregates is measured by the following method.

Measurement of Average Particle Size of Hard Segment Aggregates on High Melting Point Side (Having Large Particle Size)

An image is captured with a magnification of ×20 by using a polarization microscope (BX51-P manufactured by Olympus), the image is binarized by being subjected to an imaging process, the particle size thereof is measured with 20 cleaning blades by measuring five points for one cleaning blade (measuring five aggregates for one point), and the average particle size from 500 particle sizes is calculated.

In addition, with the image binarization, threshold values of hue, chroma, and illuminance are adjusted so as to display black for crystal portion and white for non-crystal portion by using image processing software of OLYMPUS Stream essentials (manufactured by Olympus).

Measurement of Average Particle Size of Hard Segment Aggregates on Low Melting Point Side (Having Small Particle Size)

Shape/phase analysis is performed in a phase mode (DFM) of an atomic force microscope (product name: S-image manufactured by Hitachi High-Tech Science Corporation), the particle size is measured with 3 cleaning blades by measuring three points for one cleaning blade (measuring 50 aggregates for one point), and the average particle size from 450 particle sizes is calculated.

The cantilever used is DF3 (spring constant: 1.6 N/m) and a measurement region is 2 m×2 m. In addition, in the shape/phase analysis, a phase signal of cantilever vibration which reflects adsorption or viscoelasticity of a sample surface is detected at the same time with a surface shape image, a phase distribution image is obtained, and then, contrast thereof is adjusted by a binarizing process, using image processing software of image-Pro Plus (manufactured by Media Cybernetics, Inc.).

The method of controlling the respective particle sizes of the hard segment aggregates on a high melting point side (having a large particle size) and on a low melting point side (having a small particle size) to the range described above, is not particularly limited, and for example, methods of reaction control with a catalyst, three-dimensional network control with a cross-linking agent, crystal growth control with aging conditions, and the like are used. In detail, the speed of the primary curing is increased by using a catalyst having excellent reactivity and the particle size of the hard segment aggregates on a low melting point side (having a small particle size) is controlled by the adjustment of the speed of the primary curing. Then, in secondary curing, a method of setting an aging time longer by setting a polymerization temperature lower at the time of polymerization to have an environment in that more physical crosslinks are easily proceeded, and controlling the particle size of the hard segment aggregates on a high melting point side (having a large particle size) is used.

Endothermic Peak Temperature

In the cleaning blade according to the exemplary embodiment, the member configuring the portion which comes in contact with the member to be cleaned has at least two different endothermic peak temperatures, and among them, an endothermic peak temperature (T1) on a high temperature side is preferably in a range of 180° C. to 220° C., and an endothermic peak temperature (T2) on a low temperature side is preferably in a range of 120° C. to 160° C.

The endothermic peak temperature (T1) on a high temperature side is more preferably from 185° C. to 215° C., and even more preferably from 190° C. to 210° C. On the other hand, the endothermic peak temperature (T2) on a low temperature side is more preferably from 120° C. to 140° C., and even more preferably from 120° C. to 130° C.

By setting the endothermic peak temperature (T1) on a high temperatures side to be equal to or more than 180° C., crystallinity is increased and high abrasion resistance is obtained, and on the other hand, by setting the endothermic peak temperature (T1) to be equal to or less than 220° C., the crystallinity is not excessively increased, rubber elasticity is controlled to be in a suitable range, permanent elongation is given, and generation of cracks is suppressed.

In addition, by setting the endothermic peak temperature (T2) on a low temperature side to be equal to or more than 120° C., the sliding property is improved, and on the other hand, by setting the endothermic peak temperature (T2) to be equal to or less than 160° C., compatibility with the soft segment is improved with increase of a specific surface area of the crystal portions, and mechanical strength such as modulus and tensile strength, and the like is increased.

In addition, the endothermic peak temperature (melting temperature) is measured based on ASTM D3418-99 of differential scanning calorimetry (DSC). PerkinElmer's Diamond-DSC is used for the calorimetry, a melting temperature of indium and zinc is used for temperature correction of a device detection unit, and heat of fusion of indium is used for correction of calorie. An aluminum pan is used for a calorimetry sample, and an empty pan is set for comparison and the calorimetry is performed.

When melting a solid sample, an amount of thermal energy larger than that of a reference material is absorbed as the heat of fusion, and the endothermic peak used herein means the amount of the energy at this time. If the amount of the energy is increased, the endothermic peak intensity is increased. A temperature at the time of maximum endothermic peak intensity in a DSC curve is called an endothermic peak temperature.

Herein, among the all endothermic peaks (calories) detected by DSC, highest peaks of the endothermic peaks in the temperature ranges of the T1 (from 180° C. to 220° C.) and the T2 (from 120° C. to 160° C.) are selected for T1 and T2, respectively.

A method of controlling the endothermic peak temperature (T1) on a high temperature side and the endothermic peak temperatures (T2) on a low temperature side, to the ranges described above respectively, is not particularly limited, and for example, methods of reaction control with a catalyst, three-dimensional network control with a cross-linking agent, crystal growth control with aging conditions, and the like are used. In detail, the speed of the primary curing is increased by using a catalyst having excellent reactivity and the melting temperature of the hard segment aggregates on a low melting point side (having a small particle size) is controlled by the adjustment of the speed of the primary curing. Then, in secondary curing, a method of setting an aging time longer by setting a polymerization temperature lower at the time of polymerization to have an environment in that more physical crosslinks are easily proceeded, and controlling the melting temperature of the hard segment aggregates on a high melting point side (having a large particle size) is used.

Next, a configuration of the cleaning blade according to the exemplary embodiment will be described.

In the cleaning blade of the exemplary embodiment, it is only necessary that a member (hereinafter, referred to as a "contacting member") containing polyurethane rubber and having two different endothermic peak temperatures by differential scanning calorimetry in a range of equal to or more than 100° C. may be included at least in a portion which contacts a member to be cleaned. That is, the cleaning blade may have a two-layer configuration in that a first layer which is formed of the contacting member and contacts a surface of a member to be cleaned and a second layer as a rear surface layer on the rear surface of the first layer are provided, or may have a three or more layered configuration. Also, the cleaning blade may have a configuration in that only a corner portion of the portion which contacts the member to be cleaned is formed of the contacting member and the periphery thereof is formed of another material.

Herein, the exemplary embodiment will be described in detail with reference to the drawings.

Figure 2:
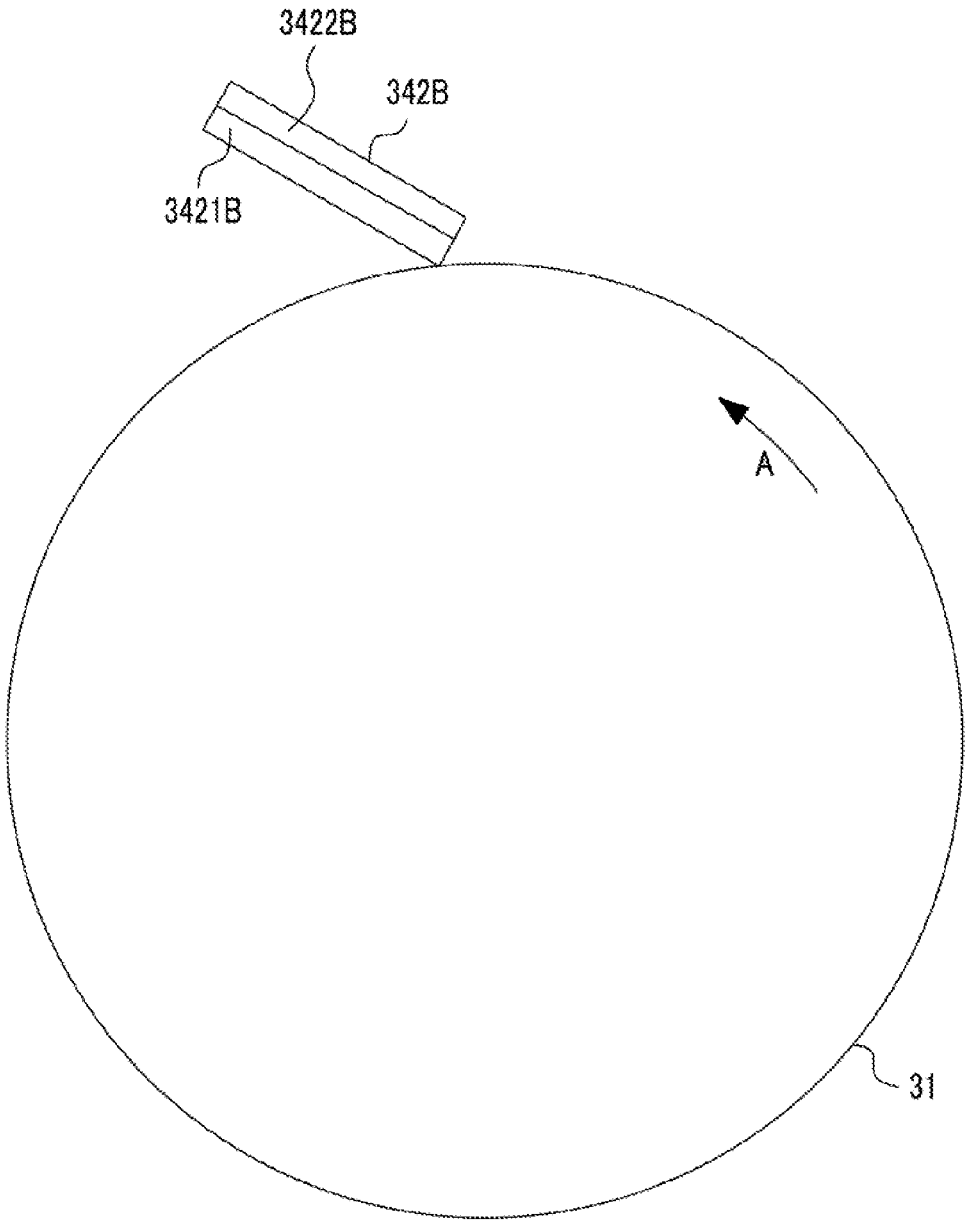
FIG. 2 is a schematic view showing another example of a cleaning blade of an exemplary embodiment.
Figure 3:
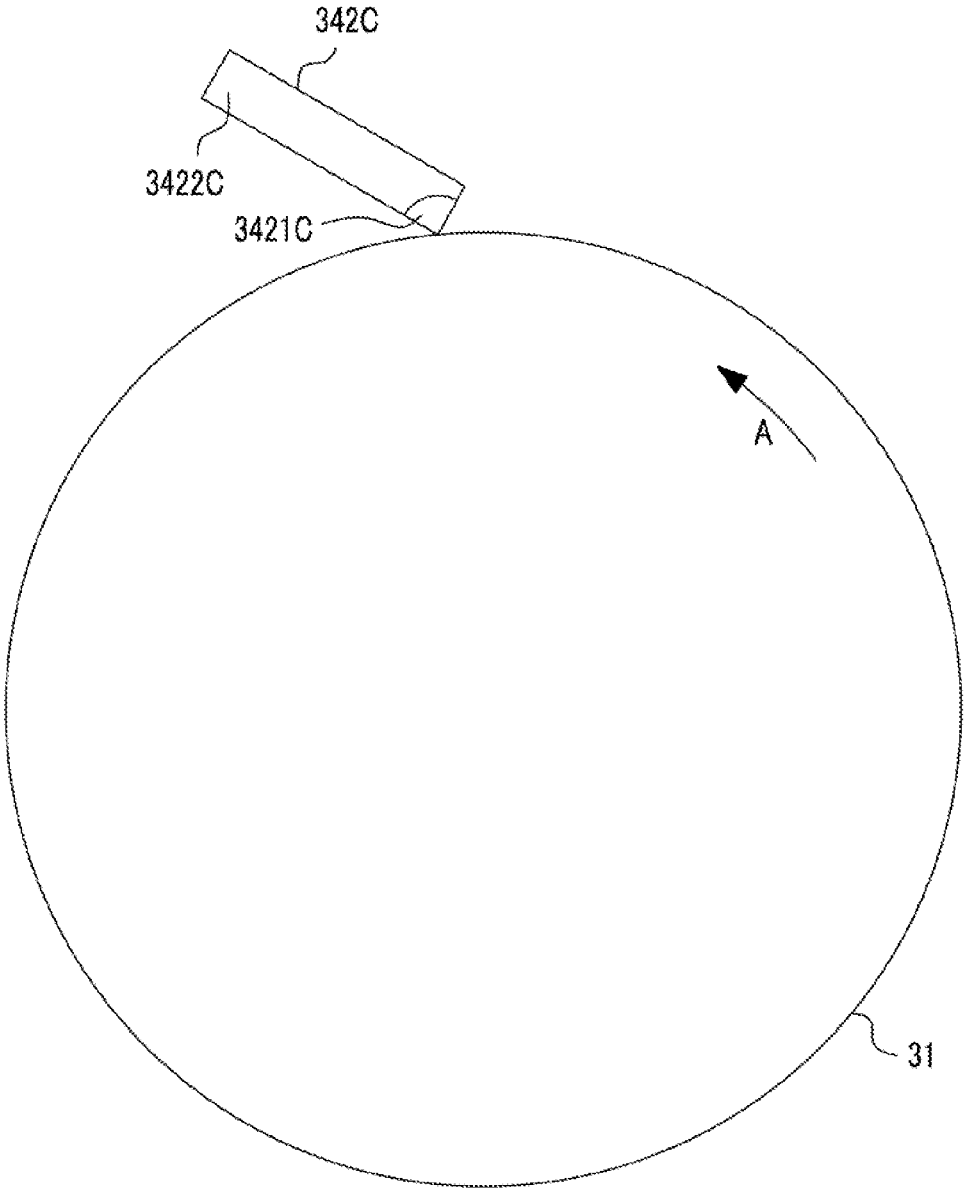
FIG. 3 is schematic view showing another example of a cleaning blade of an exemplary embodiment.

FIG. 1 is a schematic view showing a cleaning blade according to a first exemplary embodiment, and a view showing a state where the cleaning blade is in contact with a surface of a photoreceptor drum. In addition, FIG. 2 is a view showing a state where a cleaning blade according to a second exemplary embodiment is in contact with a surface of a photoreceptor drum, and FIG. 3 is a view showing a state where a cleaning blade according to a third exemplary embodiment is in contact with a surface of a photoreceptor drum.

First, each unit of the cleaning blade will be described with reference to FIG. 1. Hereinafter, as shown in FIG. 1, the cleaning blade includes a contacting portion (contacting corner portion) 3A which comes in contact with a driving image holding member (a photoreceptor dram) 31 to clean the surface of the image holding member 31, a tip surface 3B which configures one side with the contacting corner portion 3A and faces the upstream side of the driving direction (arrow A direction), a ventral surface 3C which configures one side with the contacting corner portion 3A and faces the downstream side of the driving direction (arrow A direction), and a rear surface 3D which shares one side with the tip surface 3B and opposes the ventral surface 3C.

In addition, a direction parallel with the contacting corner portion 3A is set as a depth direction, a direction from the contacting corner portion 3A to a side where the tip surface 33 is formed is set as a thickness direction, and a direction from the contacting corner portion 3A to a side where the ventral surface 3C is formed is set as a width direction.

Entirety of a cleaning blade 342A according to the first exemplary embodiment shown in FIG. 1 including the portion (contacting corner portion) 3A which comes in contact with the photoreceptor drum 31 is configured of single material, and that is to say, the cleaning blade 342A is formed of only the contacting member.

In addition, as the second exemplary embodiment shown in FIG. 2, the cleaning blade according no the exemplary embodiment may have a two-layer configuration in that a first layer 3421B which includes the portion (contacting corner portion) 3A which comes in contact with the photoreceptor dram 31, is formed over the entire surface of the ventral surface 3C side, and is formed of the contacting member, and a second layer 3422B as a rear surface layer which is formed on the rear surface 3D side with respect to the first layer and is formed of a material different from the contacting member is provided.

Further, as a third exemplary embodiment shown in FIG. 3, the cleaning blade according to the exemplary embodiment may have a configuration in that a contacting member (edge member) 3421C formed of a contacting member which includes the portion which comes in contact with the photoreceptor drum 31, that is, the contacting corner portion 3A, has a shape obtained by elongating ¼-cut of a cylinder in the depth direction, and includes a right angular portion of the shape forming the contacting corner portion 3A, and a roar surface member 3422C formed of a material different from the contacting member which covers the rear surface 3D side of the contacting member 3421C in the thickness direction and the side opposite to the tip surface 3A in the width direction, that is, configures the portion other than the contacting member 3421C.

In FIG. 3, the member including the member having a shape of ¼-cut of a cylinder is used as an example of the contacting member, however, it is not limited thereto. The contacting member may have a shape of ¼-cut of an elliptical cylinder, a square pole, or an rectangular pole.

In addition, the cleaning blade is generally used by being adhered to a rigid-plate shaped supporting material.

Composition of Contacting Member

The contacting member of the cleaning blade according to the exemplary embodiment contains the polyurethane rubber and has the two different endothermic peak temperatures by differential scanning calorimetry in a range of equal to or more than 100° C.

The polyurethane rubber is generally synthesized by polymerizing polyisocyanate and polyol. In addition, other than polyol, a resin including a functional group which may react with an isocyanate group may be used. In addition, it is preferable that the polyurethane rubber include hard segments and soft segments.

Herein, the "hard segments" and the "soft segments" mean segments which are configured of a material, and a material configuring the former is relatively harder than a material configuring the latter, and a material configuring the latter is relatively softer than a material configuring the former, in the polyurethane rubber materials.

It is not particularly limited, however, as a combination of the material configuring the hard segments (hard segment material) and the material configuring the soft segments (soft segment material), well-known resin materials may be selected so as to have a combination in which one is relatively harder than the other, and the other one is relatively softer than the first. In this exemplary embodiment, the following combination is suitable.

Soft Segment Material

First, as polyol as the soft segment material, polyester polyol obtained by a dehydration condensation of diol and dibasic acid, polycarbonate polyol obtained with a reaction of diol and alkyl carbonate, polycaprolactone polyol, polyether polyol, or the like is used. In addition, as a commercialized product of the polyol used as the soft segment material, PLACCEL 205 or PLACCEL 240 manufactured by Daicel Corporation is used.

Hard Segment Material

In addition, as the hard segment material, it is preferable to use a resin including a functional group which may react with respect to an isocyanate group. Further, a flexible resin is preferable, and an aliphatic resin including a straight-chain structure is more preferable from a viewpoint of flexibility. As a specific example, it is preferable to use an acrylic resin including two or more hydroxyl groups, a polybutadiene resin including two or more hydroxyl groups, an epoxy resin including two or more epoxy groups, or the like.

In addition, a chain extender (for example, diol or the like) which will be described later is also suitably used as the hard segment material.

As a commercialized product of the acrylic resin including two or more hydroxyl groups, for example, ACTFLOW (Grade: UMB-2005B, UMB-2005P, UMB-2005, UME-2005 or the like) manufactured by Soken Chemical & Engineering Co., Ltd is used.

As a commercialized product of the polybutadiene resin including two or more hydroxyl groups, for example, R-45HT or the like manufactured by Idemitsu Kosan Co., Ltd. is used.

As the epoxy resin including two or more epoxy groups, a resin having a hard and fragile property as a general epoxy resin of the related art is not preferable, but a resin having a softer and stronger property than the epoxy resin of the related art is preferable. As the epoxy resin, for example, in terms of a molecular structure, a resin including, in a main chain structure thereof, a structure (flexible skeleton) which may increase the mobility of the main chain is suitable, and as the flexible skeleton, an alkylene skeleton, cycloalkane skeleton, a polyoxyalkylene skeleton or the like is used, and particularly a polyoxyalkylene skeleton is suitable.

In addition, in terms of a physical property, an epoxy resin in which viscosity is low compared with molecular weight is suitable compared with the epoxy resin of the related art. In detail, weight-average molecular weight is in a range of 900±100, viscosity in 25° C. is preferably in a range of 15000±5000 mPa·s and more preferably in a range of 15000±3000 mPa·s. As a commercialized product of the epoxy resin including the properties described above, EPLICON EXA-4850-150 or the like manufactured by DIC Corporation is used.

In a case of using the hard segment material and the soft segment material, a weight ratio (hereinafter, referred to as "hard segment material ratio") of the material configuring the hard segment with respect to the total of the hard segment material and the soft segment material is preferably in a range from 10% by weight to 30% by weight, more preferably in a range from 13% by weight to 23% by weight, and even more preferably in a range from 15% by weight to 20% by weight.

Since the hard segment material ratio is equal to or more than 10% by weight, the abrasion resistance property is obtained and an excellent cleaning property is maintained over a long period. Meanwhile, since the hard segment material ratio is equal to or less than 30% by weight, the flexibility and expandability is obtained while preventing becoming too hard, the generation of the cracks is prevented, and an excellent cleaning property is maintained over a long period.

Polyisocyanate

As polyisocyanate used for the synthesis of the polyurethane rubber, for example, 4,4'-diphenyl methane diisocyanate (MDI), 2,6-toluene diisocyanate (TDI), 1,6-hexane diisocyanate (HDI), 1,5-naphthalene diisocyanate (NDI), and 3,3-dimethylphenyl-4,4-diisocyanate (TODI) are used.

In addition, in a viewpoint of easy formation of the hard segment aggregate with the desired size (particle size), as polyisocyanate, 4,4'-diphenyl methane diisocyanate (MDI), 1,5-naphthalene diisocyanate (NDI), and hexamethylene diisocyanate (HDI) are more preferable.

A blending quantity of polyisocyanate with respect to 100 parts by weight of resin including a functional group which may react with respect to the isocyanate group is preferable to be from 20 parts by weight to 40 parts by weight, more preferable to be from 20 parts by weight, to 35 parts by weight, and further preferable to foe from 20 parts by weight to 30 parts by weight.

Since the blending quantity is equal to or wore than 20 parts by weight, a large bonding amount of urethane is secured to obtain the hard segment growth, and a desired hardness is obtained. Meanwhile, since the blending quantity is equal to or less than 40 parts by weight, the hard segment does not become too large, the expandability is obtained, and the generation of the crack on the cleaning blade is suppressed.

Cross-Linking Agent

As a cross-linking agent, dial (bifunction), triol (trifunction), tetraol (tetrafunction), or the like is used, and these may be used together. In addition, as a cross-linking agent, an amine based compound may be used. Further, a tri- or higher functional cross-linking agent is preferable to be used for cross-linking. As the trifunctional cross-linking agent, for example, trimethylolpropane, glycerin, tri-isopropanolamine and the like are used.

In addition, diol may be used as a chain extender, and 1,4-butanediol or the like is used, for example.

A blending quantity of the cross-linking agent with respect to 100 parts by weight of resin including a functional group which may react with respect to the isocyanate group is preferably equal to or less than 2 parts by weight. Since the blending quantity is equal to or less than 2 parts by weight, molecular motion is not restrained due to chemical crosslink, hard segment derived from urethane bonding due to aging is largely grown, and the desired hardness is easily obtained.

Catalyst

As the catalyst, an amine-based compound such as tertiary amine, quaternary ammonium salt, an organic metal compound such as an organic tin compound or the like is used.

Examples of the tertiary amine include trialkyl amine such as triethyl amine, tetraalkyl diamine such as N,N,N',N'-tetramethyl-1,3-butane diamine, aminoalcohol such as dimethylethanol amine, ethoxylated amine, epoxylated diamine, ester amine such as bis(diethyl ethanol amine) adipate, triethylenediamine (TEDA), cyclohexylamine derivative such as N,N-dimethyl cyclohexylamine, morpholine derivative such as N-methylmorpholine, or N-(2-hydroxypropyl)-dimethylmorpholine, or piperazine derivative such as N,N'-diethyl-2-methylpiperazine, or N,N'-bis-(2-hydroxypropyl)-2-methylpiperazine is used.

Examples of the quaternary ammonium salt include 2-hydroxypropyl trimethyl ammonium octylate, 1,5-diazabicyclo[4.3.0]nonene-5 (DBN) octylate, 1,8-diazabicyclo[5.4.0]undecene-1 (DBU) octylate, DBU-oleate, DBU-p-toluene sulfonate, DBU-formate, or 2-hydroxypropyl trimethyl ammonium formate is used.

Examples of the organic tin compound include a dialkyl tin compound such as dibutyl tin dilaurate or dibutyl tin di(2-ethylhexoate), stannous 2-ethyl caproate, or stannous oleate is used.

Among the catalysts, triethylenediamine (TEDA) which is the tertiary amine is used from a viewpoint or hydrolysis resistance, and the quaternary ammonium salt is suitably used from a viewpoint of processability. Among the quaternary ammonium salt, 1,5-diazabicyclo[4.3.0]nonene-5 (DBN) octylate, 1,8-diazabicyclo[5.4.0]undecene-7 (DBU) octylate, and DBU-formate having high reactivity are suitably used.

The content of the catalyst is preferably in a range of 0.0005% by weight to 0.03% by weight, and is particularly preferably from 0.001% by weight to 0.01% by weight, with respect to the entire polyurethane rubber configuring the contacting member.

The catalysts are used alone or in combination of two or more kinds.

Method of Manufacturing Polyurethane Rubber

For manufacture of the polyurethane rubber member configuring the contacting member of the exemplary embodiment, a general method of manufacturing the polyurethane such as a prepolymer method or a one-shot method is used. Since polyurethane with excellent strength and abrasion resistance property is obtained, the prepolymer method is suitable for the exemplary embodiment, however the method of manufacturing is not limited.

Such polyurethane rubber member is molded by blending the isocyanate compound, the cross-linking agent, the catalyst and the like to the polyol described above under molding conditions to prevent unevenness of molecular arrangement.

In detail, the speed of the primary curing is increased by selecting the catalyst. That is, the particle size of the hard segment aggregates on a low melting point side is adjusted so as to have the required crystal size. In addition, in a case of adjusting a polyurethane composition, the polyurethane composition is adjusted by setting a temperature of polyol or prepolymer low or setting a temperature of curing and molding low so that the crosslink proceeds slowly. Since the urethane bonding portion is aggregated and a crystal of the hard segment is obtained by setting the temperatures (temperature of polyol or prepolymer and temperature of curing and molding) low to lower a reactive property, the temperatures are adjusted so that the particle size of the hard segment aggregates on a high melting point side becomes the desired crystal size.

Accordingly, the polyurethane rubber member including two endothermic peak temperatures of crystal melting energy at the time of measuring the DSC is molded.

In addition, the amounts of the polyol, the polyisocyanate, the cross-linking agents, and catalysts, a ratio of cross-linking agents, and the like are adjusted within a desired range.

In addition, the cleaning blade is manufactured by molding the composition for cleaning blade formation prepared by the method described above in a sheet shape, using centrifugal molding or extrusion molding and performing a cut process and the like.

Herein, an example of a method of manufacturing the contacting member of the cleaning blade will be described in detail.

First, the soft segment material (for example, polycaprolactone polyol) and a chain extender, for example, as the hard segment material (1,4-butane diol or the like) are mixed (for example, a weight ratio of 8:2).

Next, the isocyanate compound (for example, 4,4'-diphenyl methane diisocyanate) is added with respect to the mixture of the soft segment material and the chain extender, and reacts under a nitrogen atmosphere for example. At that time, the temperature is preferable to be from 60° C. to 150° C. and more preferable to be from 80° C. to 130° C. In addition, the reaction time is preferable to foe from 0.1 hour to 3 hours, and more preferable to be from 1 hour to 2 hours.

Next, the isocyanate compound is further added to the mixture, and the mixture is reacted under a nitrogen atmosphere for example, to obtain a prepolymer. At that time, the temperature is preferable to be from 40° C. to 100° C. and more preferable to be from 60° C. to 90° C. In addition, the reaction time is preferable to be from 30 minutes to 6 hours, and more preferable to be from 1 hour to 4 hours.

Next, the temperature of the prepolymer is increased and subjected to defoaming under the reduced pressure. At that time, the temperature is preferable to be from 60° C. to 120° C. and more preferable to be from 80° C. to 100° C., In addition, the reaction time is preferable to be from 10 minutes to 2 hours, and more preferable to be from 30 minutes to 1 hour.

After that, a catalyst (for example, 1,8-diazabicyclo[5.4.0] undecene-7 (DBU) octylate) and a cross-linking agent (for example, trimethylolpropane) are further added and mixed with respect to the prepolymer, and a composition for the cleaning blade formation is prepared.

Next, the composition for the cleaning blade formation is poured into a mold of a centrifugal molding machine, and subjected to the curing reaction. At that time, the mold temperature is preferable to be from 80° C. to 160° C., and more preferable to be from 100° C. to 140° C. In addition, the reaction time is preferable to be from 20 minutes to 3 hours, and more preferable to be from 30 minutes to 2 hours.

Further, the mold is subjected to cross-linking reaction, cooled, and cut, and accordingly, the cleaning blade is formed. The temperature of aging by heating in the cross-linking reaction is preferable to be from 70° C. to 130° C., and more preferable to be from 80° C. to 130° C., and further more preferable to be from 100° C. to 120° C. In addition, the reaction time is preferable to be from 1 hour to 48 hours, and more preferable to be from 10 hours to 24 hours.

Physical Property

In the contacting monitor, a ratio of the physical crosslink (cross-link with hydrogen bonding between hard segments) to the chemical crosslink (crosslink with cross-linking agent) "1" in the polyurethane rubber is preferably 1:0.8 to 1:2.0, and more preferably 1:1 to 1:1.8.

Since the ratio of the physical crosslink to the chemical crosslink is equal to or more than the lower limit, the hard segment aggregate further grows and an effect of the low friction property derived from the crystal is obtained. Meanwhile, since the ratio of the physical crosslink to the chemical crosslink is equal to or less than the upper limit, an effect of maintaining the toughness is obtained.

In addition, the ratio of the chemical crosslink and the physical crosslink is calculated using the following Mooney-Rivlin equation.

$$\sigma=2C_1(\lambda-1/\lambda^2)+2C_2(1-1/\lambda^3)$$

$\sigma$: stress, $\lambda$: strain, $C_1$: chemical crosslink density, $C_2$: physical crosslink density In addition, $\sigma$ and $\lambda$ at the time of extension of 10% are used from a stress-strain line by a tension test.

In the contacting member, a ratio of the hard segment to the soft segment "1" in the polyurethane rubber is preferable to be 1:0.15 to 1:0.3, and more preferable to be 1:0.2 to 1:0.25.

Since the ratio of the hard segment to the soft segment. is equal to or more than the lower limit, an amount of hard segment aggregates increases and thus an effect of the low-friction property is obtained. Meanwhile, since the ratio of the hard segment to the soft segment is equal to or less than the upper limit, an effect of maintaining the toughness is obtained.

In addition, with the ratio of the soft segment and the hard segment, a composition ratio is calculated from a spectrum area of isocyanate a chain extender as the hard segment component, and polyol as the soft segment component, using $^{1}$H-NMR.

The weight-average molecular weight of the polyurethane rubber member of the exemplary embodiment is preferably in a range of 1,000 to 4,000, and more preferably in a range of 1,500 to 3,500.

Composition of Non-Contacting Member

Next, composition of the non-contacting member of a case where the contacting member and the region other than the contacting member (non-contacting member) of the cleaning blade of the exemplary embodiment are configured of materials different from each other, as the second exemplary embodiment shown in FIG. 2 or the third exemplary embodiment shown in FIG. 3 will be described.

The non-contacting member of the cleaning blade according to the exemplary embodiment is not particularly limited, and any known materials may be used.

Impact Resilience

It is preferable that the non-contacting member be configured of a material having impact resilience at 50° C. of equal to or less than 70%. The impact resilience at 50° C. is more preferably equal to or less than 60% and even more preferably equal to or less than 50%. The lower limit thereof is more preferably equal to or more than 30% and even more preferably equal to or more than 40%.

The measurement of the impact resilience (%) at 50° C. is performed under an environment at 50° C. based on JIS K6255 (1996). In addition, in a case where the size of the non-contacting member of the cleaning blade is equal to or larger than the dimension of a standard test piece of JIS K6255, the measurement described above is performed by cutting the part to be equal to the dimension of the test piece from the member. Meanwhile, in a case where the size of the non-contacting member is smaller than the dimension of the test piece, a test piece is formed with the same material as the member, and the measurement is performed for the test piece.

The method of controlling the 50° C. impact resilience of the non-contacting member is not particularly limited, and if the non-contacting member is polyurethane, for example, the 50° C. impact resilience tends to become larger by adjusting a glass transition temperature (Tg) through decrease in molecular weight or hydrophobization of polyol.

Permanent Elongation

In addition, it is preferable that the non-contacting member of the cleaning blade according to the exemplary embodiment be configured with a material having 100% permanent elongation of equal to or less than 1.0%. The 100% permanent elongation thereof is more preferably equal to or less than 0.5% and even more preferably equal to or less than 0.4%. In addition, the lower limit thereof is more preferably equal to or more than 0.1% and even more preferably equal to or more than 0.2%.

Herein, a method of measuring the 100% permanent elongation (%) will be described.

A strip test piece is used according to JIS K6262 (1997) and 100% tensile strain is applied and the test piece is kept for 24 hours, and the measurement is performed with gauge lengths as the following equation.

$$Ts=(L2-L0)/(L1-L0)\times 100$$

Ts: permanent elongation

L0: gauge length before tensile strain is applied

L1: gauge length at the time of tensile strain is applied

L2: gauge length after tensile strain is applied

In addition, in a case where the size of the non-contacting member of the cleaning blade is equal to or larger than the dimension of the standard strip test piece of JIS K6262, the measurement is performed by cutting the part to be equal to the dimension of the strip test piece from the member. Meanwhile, in a case where the size of the non-contacting member is smaller than the dimension of the strip test piece, a strip test piece is formed with the same material as the member, and the measurement described above is performed for the strip test piece.

The method of controlling the 100% permanent elongation of the non-contacting member is not particularly limited, but the 100% permanent elongation of the non-contacting member tends to fluctuate by adjusting amounts of cross-linking agents, or molecular weight of polyol if the non-contacting member is polyurethane.

As a material used for the non-contacting member, polyurethane rubber, silicon rubber, fluoro-rubber, chloroprene rubber, butadiene rubber, or the like is used, for example. The polyurethane rubber is preferable among the above materials. As the polyurethane rubber, ester based polyurethane and ether based polyurethane are used, and ester based polyurethane is particularly preferable.

In addition, in a case of manufacturing the polyurethane rubber, there is a method using polyol and polyisocyanate.

As polyol, polytetramethylether glycol, polyethylene adipate, polycaprolactone or the like is used.

As polyisocyanate, 2,6-toluene diisocyanate (TDI), 4,4'-diphenyl methane diisocyanate (MDI), paraphenylene diisocyanate (PPDI), 1,5-naphthalene diisocyanate (NDI), 3,3-dimethyldiphenyl-4,4'-diisocyanate (TODI) or the like is used. Among them, MDI is preferable.

In addition, as a curing agent for curing polyurethane, a curing agent such as 1,4-butanediol or trimethylolpropane, ethylene glycol, or a mixture thereof is used.

To describe the exemplary embodiment with a specific example, it is preferable that 1,4-butanediol and trimethylolpropane as curing agents be used with prepolymer generated by mixing and reacting diphenyl methane-4,4-diisocyanate with respect to polytetramethylether glycol which is subjected to a dewatering process. In addition, an additive such as a reaction conditioning agent may be added thereto.

As a method of manufacturing the non-contacting member, a well-known method of the related art is used according to raw materials used for the manufacturing, and for example, the member is prepared by forming sheets using the centrifugal molding, the extrusion molding, or the like and performing a cut process in a predetermined shape.

Manufacture of Cleaning Blade

In a case of the cleaning blade formed of only the contacting member shown in FIG. 1, the cleaning blade is manufactured by the molding method of the contacting member described above.

In addition, in a case of the cleaning blade having the multiple-layer configuration such as the two-layer configuration shown in FIG. 2, the cleaning blade is manufactured by bonding the first layer as the contacting member and a second layer as the non-contacting member (plural layers in a case of a layer configuration with three layers or more), together. As the bonding method, a double-faced tape, various adhesive agents or the like are suitably used. In addition, the plural layers may be adhered to each other by pouring materials of each layer into a mold with a time difference when molding and bonding each material without providing adhesive layers.

In a case of a configuration including the contacting member (edge member) and the non-contacting member (rear surface member) shown in FIG. 3, a first mold including a cavity (a region in which a composition for formation of the contacting member is poured) corresponding to a semicircular columnar shape which is obtained by overlapping the ventral surface 3C sides of two contacting members 3421C shown in FIG. 3 each other, and a second mold including a cavity corresponding to a shape obtained by overlapping the ventral surface 3C sides of two of each contacting member 3421C and non-contacting member 3422C, each other, are prepared. A first molded material, having a shape obtained by overlapping two contacting members 3421C each other is formed by pouring the composition for formation of the contacting member into the cavity of the first mold and curing it. Then, after detaching the first mold, the second mold is installed so as to dispose the first molded material inside the cavity of the second mold. Next, a second molded material having a shape obtained by overlapping the ventral surface 3C sides of two of each contacting member 3421C and non-contacting member 3422C to each other, is formed by pouring a composition for formation of the non-contacting member into the cavity of the second mold so as to cover the first molded material and curing it. Then, the center of the formed second molded material, that is, the portion to be the ventral surface 3C is cut, the contacting member with a semicircular columnar shape is segmented at the center thereof and out so as to be a columnar shape with cut of ¼, and further cut to obtained the predetermined dimension, and thus, the cleaning blade shown in FIG. 3 is obtained.

Purpose

When cleaning the member to be cleaned using the cleaning blade of the exemplary embodiment, as the member to be cleaned which is the target for cleaning, it is not particularly limited as long as it is a member of which a surface is necessary to be cleaned in the image forming apparatus. For example, an intermediate transfer member, a charging roller, a transfer roller, a transporting belt for material to be transferred, paper transporting roller, a detoning roller for further removing toner from a cleaning brush for removing toner from an image holding member, and the like are exemplified, however, in the exemplary embodiment, the image holding member is particularly preferable.

Cleaning Device, Process Cartridge and Image Forming Apparatus

Next, a cleaning device, a process cartridge, and an image forming apparatus using the cleaning blade of the exemplary embodiment will be described.

The cleaning device of the exemplary embodiment is not particularly limited as long as it includes the cleaning blade of the exemplary embodiment as a cleaning blade which comes in contact with a surface of a member to be cleaned and cleans the surface of the member to be cleaned. For example, as a configuration example of the cleaning device, a configuration, in which the cleaning blade is fixed so that an edge tip faces an opening portion side in a cleaning case including an opening portion on a side of the member to be cleaned and a transporting member which guides foreign materials such as waste toner collected from the surface of the member to be cleaned by the cleaning blade to a foreign material collecting container is included, is used. In addition, two or more cleaning blades of the exemplary embodiment may be used in the cleaning device of the exemplary embodiment.

In a case of using the cleaning blade of the exemplary embodiment to clean the image holding member, in order to prevent an image deletion when forming an image, a force NF (Normal Force) to press the cleaning blade against the image holding member is preferably in a range from 1.3 gf/mm to 2.3 gf/mm, and more preferably in a range from 1.6 gf/mm to 2.0 gf/mm.

In addition, a length of a tip portion of the cleaning blade wedged in the image holding member is preferably in a range from 0.8 mm to 1.2 mm, and more preferably in a range from 0.9 mm to 1.1 mm.

An angle W/A (Working Angle) of the contacting portion of the cleaning blade and the image holding member is preferably in a range from 8° to 14°, and more preferably in a range from 10° to 12°.

Meanwhile, the process cartridge of the exemplary embodiment is not particularly limited as long as it includes the cleaning device of the exemplary embodiment as the cleaning device which comes in contact with surfaces of one or more members to be cleaned such as the image holding member, the intermediate transfer member, and the like and cleans the surfaces of the members to be cleaned, and for example, a process cartridge, that includes the image holding member and the cleaning device of the exemplary embodiment which cleans the surface of the image holding member and that is detachable with respect to the image forming apparatus, is exemplified. For example, if it is a so-called tandem machine including the image holding member corresponding to toner of each color, the cleaning device of the exemplary embodiment may be provided for each image holding member. In addition, other than the cleaning device of the exemplary embodiment, a cleaning brush or the like may be used together.

Specific Examples of Cleaning Blade, Image Forming Apparatus, and Cleaning Device Next, specific examples of the cleaning blade and image forming apparatus and the cleaning device using the cleaning blade of the exemplary embodiment will be described with reference to the drawing.

According to the exemplary embodiment, an image forming apparatus includes an image holding member; a charging device that charges the image holding member; an electrostatic latent image forming device that forms an electrostatic latent image on a surface of a charged image holding member; a developing device that develops the electrostatic latent image formed on the surface of the image holding member with toner to form a toner image; a transfer device that transfers the toner image formed on the image holding member on a recording medium; and the cleaning device according to the exemplary embodiment that brings the cleaning blade into contact with the surface of the image holding member after the transfer of the toner image by the transfer device for cleaning.

Figure 4:
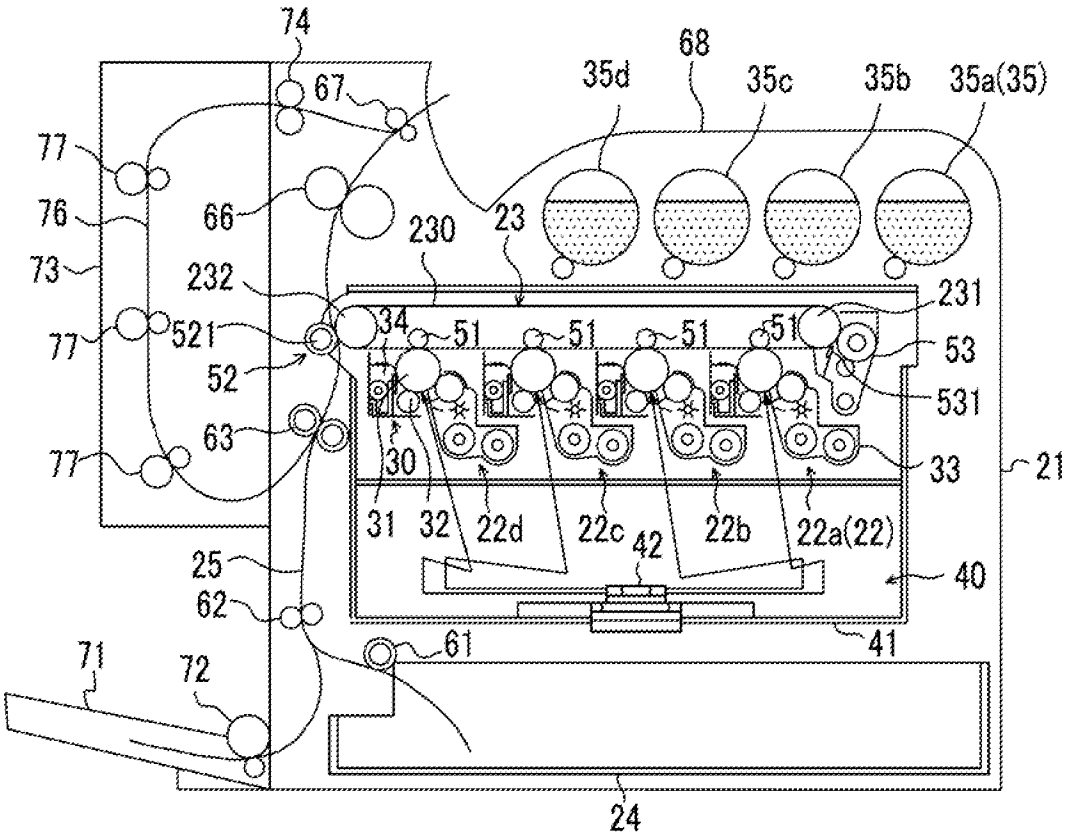
FIG. 4 is a schematic view showing an example of an image forming apparatus according to an exemplary embodiment.

FIG. 4 is a schematic view showing an example of the image forming apparatus according to the exemplary embodiment, and shows a so-called tandem type image forming apparatus.

In FIG. 4, reference numeral 21 denotes a main member housing, reference numerals 22 and 22*a* to 22*d* denote image forming units, reference numeral 23 denotes a belt module, reference numeral 24 denotes a recording medium supply cassette, reference numeral 25 denotes a recording medium transporting path, reference numeral 30 denotes each photoreceptor unit, reference numeral 31 denotes a photoreceptor drum, reference numeral 33 denotes each developing unit, reference numeral 34 denotes a cleaning device, reference numerals 35 and 35*a* to 35*d* denote toner cartridges, reference numeral 40 denotes an exposing unit, reference numeral 41 denotes a unit case, reference numeral 42 denotes a polygon mirror, reference numeral 51 denotes a primary transfer unit, reference numeral 52 denotes a secondary transfer unit, reference numeral 53 denotes a belt cleaning device, reference numeral 61 denotes a sending-out roller and reference numeral 62 denotes a transporting roller, reference numeral 63 denotes a positioning roller, reference numeral 66 denotes a fixing device, reference numeral 67 denotes a discharge roller, reference numeral 68 denotes a paper discharge unit, reference numeral 71 denotes a manual feeder, reference numeral 72 denotes a sending-out roller, reference numeral 73 denotes a double side recording unit, reference numeral 74 denotes a guide roller, reference numeral 76 denotes a transporting path, reference numeral 77 denotes a transporting roller, reference numeral 230 denotes an intermediate transfer belt, reference numerals 231 and 232 denote support rollers, reference numeral 521 denotes a secondary transfer roller, and reference numeral 531 denotes a cleaning blade.

In the tandem type image forming apparatus shown in FIG. 4, the image forming units 22 (in detail, 22*a* to 22*d*) with four colors (in the exemplary embodiment, yellow, magenta, cyan and black) are arranged in the main body housing 21, and on the upper portion thereof, the belt module 23 in which the intermediate transfer belt 230 which is circulation-transported along the arrangement direction of each image forming unit 22 is included, is disposed. Meanwhile, the recording medium supply cassette 24, in which a recording medium (not shown), such as paper, is accommodated is disposed on the lower portion of the main member housing 21, and the recording medium transporting path 25, which is a transporting path of the recording medium from the recording medium supply cassette 24, is disposed in a vertical direction.

In the exemplary embodiment, each image forming unit 22 (22*a* to 22*d*) forms toner images for yellow, magenta, cyan, and black (arrangement is not particularly limited to this order), in order from upstream in a circulation direction of the intermediate transfer belt 230, and includes each photoreceptor unit 30, each developing unit 33, and one common exposing unit 40.

Herein, each photoreceptor unit 30 is obtained by combining the photoreceptor drum 31, a charging device (charging roller) 32 which charges the photoreceptor drum 31 in advance, and the cleaning device 34 which removes remaining toner on the photoreceptor drum 31 integrally as sub-cartridges, for example.

In addition, the developing unit 33 develops an electrostatic latent image formed by exposing in the exposing unit 40 on the charged photoreceptor drum 31 with the corresponding colored toner (in the exemplary embodiment, for example, negative polarity), and configures the process cartridge (so-called customer replaceable unit) by being integrated with the sub-cartridge formed of the photoreceptor unit 30, for example.

Further, the process cartridge may also be used alone by separating the photoreceptor unit 30 from the developing unit 33. In addition, in FIG. 4, reference numerals 35 (35*a* to 35*d*) are toner cartridges (toner supplying path is not shown) for supplying each color component toner to each developing unit 33.

Meanwhile, the exposing unit 40 is disposed to accommodate, for example, four semiconductor lasers (not shown), one polygon mirror 42, an imaging lens (not shown), and each mirror (not shown) corresponding to each photoreceptor unit 30 in the unit case 41, to scan light from the semiconductor laser for each color component with deflection by the polygon mirror 42, and to guide an optical image to an exposing point on the corresponding photoreceptor drum 31 through the imaging lens and mirrors.

In addition, in the exemplary embodiment, the belt module 23 includes the intermediate transfer belt 230 to bridge between a pair of support rollers (one roller is a driving roller) 231 and 232, and each primary transfer unit (in this example, primary transfer roller) 51 is disposed on the back surface of the intermediate transfer belt 230 corresponding to the photoreceptor drum 31 of each photoreceptor unit 30. Since a voltage having reverse polarity with charging polarity of toner is applied to the primary transfer unit 51, the toner image on the photoreceptor drum 31 is electrostatically transferred to the intermediate transfer belt 230 side. Further, the secondary transfer unit 52 is disposed on a portion corresponding to the support roller 232 on the downstream of the image forming unit 22*d* which is on the most downstream of the intermediate transfer belt 230, and performs second transfer (collective transfer) of the primary transfer image on the intermediate transfer belt 230 to a recording medium.

In the exemplary embodiment, the secondary transfer unit 52 includes the secondary transfer roller 521 which is disposed in pressure-contact with the toner image holding surface side of the intermediate transfer belt 230, and a back surface roller (in this example, also serves as the support roller 232) which is disposed on the rear surface of the intermediate transfer-belt 230 to be formed as an opposite electrode of the secondary transfer roller 521. In addition, for example, the secondary transfer roller 521 is grounded, and bias having the same polarity with the charging polarity of the toner is applied to the back surface roller (support roller 232).

In addition, the belt cleaning device 53 is disposed on the upstream, of the image forming unit 22*a* which is on the most upstream of the intermediate transfer belt 230, and removes the remaining toner on the intermediate transfer belt 230.

In addition, a sending-out roller 61 which picks up a recording medium is disposed on the recording medium supply cassette 24, the transporting roller 62 which sends out the recording medium is disposed right behind the sending-out roller 61, and a registration roller (positioning roller) 63 which supplies the recording medium to the secondary transfer portion at a predetermined timing is disposed on the recording medium transporting path 25 which positions right in front of the secondary transfer portion. Meanwhile, the fixing device 66 is disposed on the recording medium transporting path 25 which is positioned on the downstream of the secondary transfer portion, the discharge roller 67 for discharge of the recording medium is disposed on downstream of the fixing device 66, and the discharged recording medium is accommodated in the paper discharge unit 68 formed on the upper portion of the main member housing 21.

In addition, in the exemplary embodiment, the manual feeder (MSI) 71 is disposed on the side of the main member housing 21, and the recording medium on the manual feeder 71 is sent towards the recording medium transporting path 25 through the sending-out roller 72 and the transporting roller 62.

In addition, the double side recording unit 73 is supplemented in the main member housing 21. When a double side mode which performs image recording on double sides of a recording medium is selected, the double side recording unit 73 reverses a recording medium with the single side recorded by the discharge roller 67. And the discharge roller 67 brings the recording medium to the inner portion through the guide roller 74 in front of an inlet, transports the recording medium in the inner portion through the transporting rollers 77, transport the recording medium along the recording medium return transport path 76, and supplies the recording medium to the positioning roller 63 side again.

Next, the cleaning device 34 which is disposed in the tandem type image forming apparatus shown in FIG. 4 will be described in detail.

Figure 5:
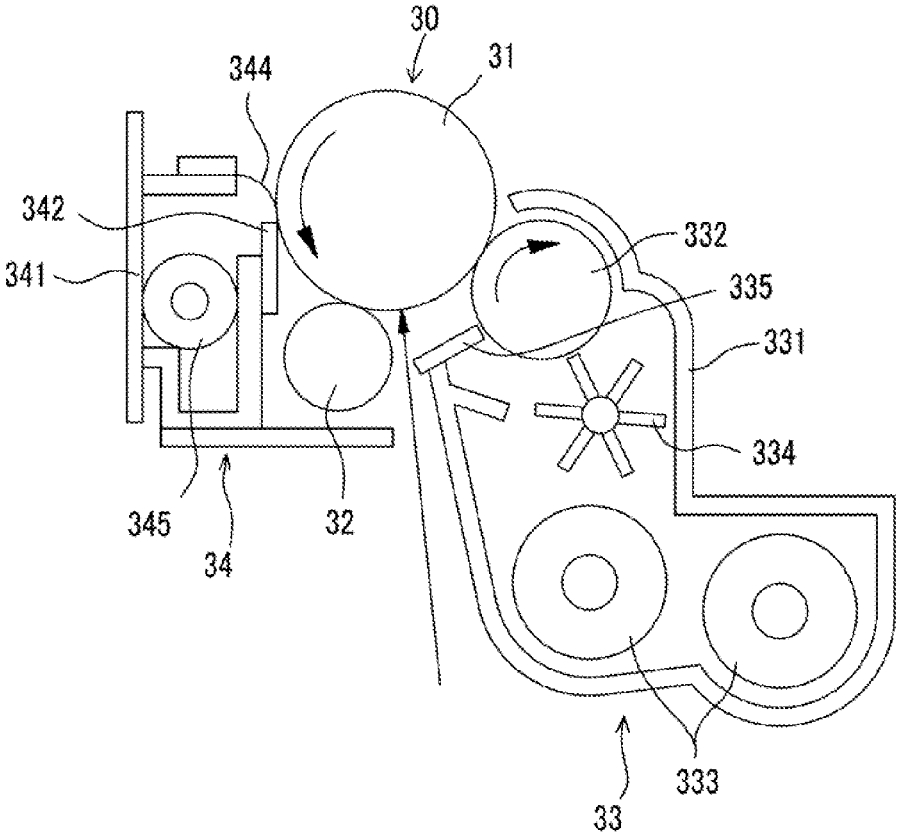
FIG. 5 is a schematic cross-sectional view showing an example of a cleaning device according to an exemplary embodiment.

FIG. 5 is a schematic cross-sectional view showing an example of the cleaning device of the exemplary embodiment, and is a view showing the cleaning device 34, the photoreceptor drum 31 as the sub-cartridge, the charging roller 32, and the developing unit 33 shown in FIG. 4.

In FIG. 5, reference numeral 32 denotes the charging roller (charging device), reference numeral 331 denotes a unit case, reference numeral 332 denotes a developing roller, reference numerals 333 denote toner transporting members, reference numeral 334 is a transporting paddle, reference numeral 335 is a trimming member, reference numeral 341 denotes a cleaning case, reference numeral 342 denotes a cleaning blade, reference numeral 344 denotes a film seal, and reference numeral 345 denotes a transporting member.

The cleaning device 34 includes the cleaning case 341 which accommodates the remaining toner and which is open facing the photoreceptor drum 31, and in the cleaning device 34, the cleaning blade 342 which is disposed to come in contact with the photoreceptor drum 31 is attached to the lower edge of the opening of the cleaning case 341 through a bracket (not shown). Meanwhile, the film seal 344 which is held air-tightly with respect to the photoreceptor drum 31 is attached to the upper edge of the opening of the cleaning case 341. In addition, reference numeral 345 denotes a transporting member which guides waste toner accommodated in the cleaning case 341 to a waste toner container on the side.

Next, the cleaning blade provided in the cleaning device 34 will be described in detail with reference to the drawing.

FIG. 1 is a schematic cross-sectional view showing an example of the cleaning blade of the exemplary embodiment, and is a view showing the cleaning blade 342 shown in FIG. 5 and the photoreceptor drum 31 which comes in contact therewith.

In addition, in the exemplary embodiment, in all cleaning devices 34 of respective image forming units 22 (22*a* to 22*d*), the cleaning blade of the exemplary embodiment is used as the cleaning blade 342, and the cleaning blade of the exemplary embodiment may be used for the cleaning blade 531 used in the belt cleaning device 53.

In addition, as shown in FIG. 5, for example, the developing unit (developing device) 33 used in the exemplary embodiment includes the unit case 331 which accommodates a developer and opens facing the photoreceptor drum 31. Herein, the developing roller 332 is disposed on the portion which faces the opening of the unit case 331, and toner transporting members 333 for stirring and transporting of the developer are disposed in the unit case 331. Moreover, the transporting paddle 334 may be disposed between the developing roller 332 and the toner transporting member 333.

When developing, after supplying the developer to the developing roller 332, the developer is transported to a developing area facing the photoreceptor drum 31 in a state where the layer thickness of the developer is regulated in the trimming member 335, for example.

In the exemplary embodiment, as the developing unit 33, a two-component developer formed of toner and a carrier for example, is used, however, a single-component developer formed only of the toner may be used.

Next, an operation of the image forming apparatus according to the exemplary embodiment will be described. First, when respective image forming units 22 (22*a* to 22*d*) form, single-colored toner images corresponding to each color, the single-colored toner images of each color are sequentially superimposed so as to match with original document information and subjected to primary transfer to the surface of the intermediate transfer belt 230. Next, the colored toner image transferred to the surface of the intermediate transfer belt 230 are transferred to the surface of the recording medium in the secondary transfer unit 52, and the recording medium to which the colored toner image is transferred is subjected to a fixing process by the fixing device 66, and then, is discharged to the paper discharge unit 68.

Meanwhile, in the respective image forming units 22 (22*a* to 22*d*), the remaining toner on the photoreceptor drum 31 is cleaned by the cleaning device 34, and the remaining toner on the intermediate transfer belt 230 is cleaned by the belt cleaning device 53.

In such image forming process, each remaining toner is cleaned by the cleaning device 34 (or belt cleaning device 53).

In addition, the cleaning blade 342 may be fixed through a spring material, other than being directly fixed with a frame member in the cleaning device 34 as shown in FIG. 5.

EXAMPLES

Hereinafter, Examples of the invention will be described in detail with examples, however the invention is not limited only to the following examples. In addition, in the description below, a "part" refers to a "part by weight".

Example 1

Cleaning Blade A1

First, polycaprolactone polyol (PLACCEL 205 manufactured by Daicel Corporation with an average molecular weight of 529 and a hydroxyl value of 212 KOHmg/g) and polycaprolactone polyol (PLACCEL 240 manufactured by Daicel Corporation with an average molecular weight of 4155 and a hydroxyl value of 27 KOHmg/g) are used as the soft segment materials of polyol components. In addition, the soft segment materials and the hard segment materials are mixed with a ratio of 8:2 (weight ratio) by using the chain extender, 1,4-butanediol (manufactured by Mitsubishi Gas Chemical Company, Inc.) as the hard segment material.

Next, 6.26 parts of 4,4'-diphenyl methane diisocyanate (MILLIONATE MT manufactured by Nippon Polyurethane Industry Co., Ltd.) as the isocyanate compound is added to 100 parts of the mixture of the soft segment materials and the hard segment material, and the resultant mixture is reacted under a nitrogen atmosphere at 70° C. for three hours. In addition, the amount of the isocyanate compound used for this reaction is selected so that a ratio (isocyanate group/hydroxyl group) of the isocyanate group with respect to the hydroxyl group included in a reaction system becomes 0.5.

Next, 34.3 parts of the isocyanate compound is further added thereto, and the resultant mixture is reacted under a nitrogen atmosphere at 70° C. for three hours, and prepolymer is obtained. In addition, the entire amount of the isocyanate compound used when using the prepolymer is 40.56 parts.

Next, the temperature of the prepolymer is increased to 100° C., followed by defoaming for one hour under the reduced pressure. After that, 7.14 parts of mixture (weight ratio=60/40) of 1,4-butanediol and trimethylolpropane, and 0.005% parts of 1,8-diazabicyclo[5.4.0]undecene-7 octylate (product name: DBU octylate manufactured by San-Apro Ltd.) as the catalyst are added to 100 parts of prepolymer and mixed for three minutes without foaming, and a composition A1 for cleaning blade formation is prepared.

Next, the composition A1 for cleaning blade formation is poured into the centrifugal molding machine in which a mold is adjusted at 140° C., and subjected to the curing reaction for one hour. Next, the composition is subject to aging by heating at 110° C. for 24 hours, cooled, and then cut, to obtain a cleaning blade A1 having a length of 8 mm and a thickness of 2 mm.

Example 2

A cleaning blade A2 is obtained by the method described in Example 1, except for changing the mold temperature to 145° C. and the aging temperature to 120° C.

Example 3

A cleaning blade A3 is obtained by the method described in Example 1, except for changing the mold temperature to 145° C. and the aging temperature to 100° C.

Example 4

A cleaning blade A4 is obtained by the method described in Example 1, except for changing the catalyst amount to 0.003 parts, the mold temperature to 130° C., and the aging temperature to 100° C.

Example 5

A cleaning blade A5 is obtained by the method described in Example 1, except for changing the weight ratio of the mixture of 1,4-butanediol and trimethylolpropane to (40/60) and the mold temperature to 145° C.

Example 6

A cleaning blade A6 is obtained by the method described in Example 1, except for changing the catalyst amount to 0.003 parts, the mold temperature to 120° C., the aging temperature to 100° C., and the aging time to 36 hours.

Example 7

A cleaning blade A7 is obtained by the method described in Example 1, except for changing the aging temperature to 130° C.

Example 8

A cleaning blade A8 is obtained by the method described in Example 1, except for changing the aging temperature to 95° C. and the aging time to 48 hours.

Comparative Example 1

A cleaning blade A8 is obtained by the method described in Example 1, except for using tetramethylalkylene diamine without using the catalyst (1,8-diazabicyclo[5.4.0]undecene-7 (DBU) octylate).

Measurement of Physical Properties

DSC Measurement

The endothermic peak temperature (melting temperature) of the cleaning blade by the differential scanning calorimetry is measured based on ASTM D3418-99 by differential scanning calorimetry (DSC). PerkinElmer's Diamond-DSC is used for the calorimetry, a melting temperature of indium and zinc is used for temperature correction of a device detection unit, and heat of fusion of indium is used for correction of calorie. An aluminum pan is used for a calorimetry sample, and an empty pan is set for comparison and the calorimetry is performed. The temperature rising rate at the time of measurement by the DSC at this time is set to 3° C./min, and the measurement temperature range is from 20° C. to 250° C.

Particle Size of Hard Segment Aggregates

The average particle size of the hard segment aggregates on a high melting point side (having a large particle size) and the average particle size of the hard segment aggregates on a low melting point side (having a small particle size) of the hard segment of the cleaning blade are measured of the method described above.

Hardness

In addition, the hardness (JIS-A) of the cleaning blade is measured by the following method. The hardness (JIS-A.) is hardness measured using durometer Type A described in JISK6253 (1997), and is measured by acquiring an average value of the three point measurement of the photoreceptor contacting surface of the blade in an axial direction.

Modulus (Tensile Test)

The modulus is measured by the following tensile test.

Based on JIS-K6251, the calculation is performed at a tensile rate of 500 mm/min using a dumbbell-shaped No. 3 type test piece, and the 100% modulus M is obtained by the stress at the time of 100% strain. In addition, strograph AE elastomer manufactured by Toyo Seiki Seisaku-Sho, Ltd. is used as the measuring device.

Image Quality Evaluation Test

Configuration of Image Forming Apparatus

The obtained cleaning blades of Examples and Comparative Examples are mounted as clearing blades for photoreceptor drums of an image forming apparatus (product name: DocuCentre-II C7500 manufactured by Fuji Xerox Co., Ltd.) shown in FIG. 4, respectively.

- Photoreceptor drum: organic photosensitive material (Φ=30 mm)
- Process speed: three patterns of 250 mm/sec, 110 mm/sec, and 55 mm/sec
- Charging device: charging roll of superimposed alternating current on direct current
- Developing device: two-component magnetic brush developing device
- Cleaning blade: length of 320 mm, width of 12 mm, thickness of 2 mm, free length of 8 mm, contacting angle of 25 degrees, and pressing force NF of 2.0 gf/mm In the test, using a toner obtained by the polymerization method and having shape factors distributed in a range of 123 to 128 and having an average particle size of 6 μm, a two-component developer including this toner is accommodated in the developing device of the image forming apparatus, and is used. By repeating the test printing (area ratio of 5% per 1 color) by the image forming apparatus using five sheets of the printing paper, the printing of 50,000 sheets is performed under the following environment, respectively. The stress environment is set to have a process speed of 250 mm/sec, high temperature and high humidity (32.5° C., 85% RH), low temperature and low humidity (5° C., 15% RH), and medium temperature and medium humidity (22° C., 55% RH).

Blade Damage Evaluation

After the test, edge cracks on the cleaning blade and occurrence of curling on the cleaning blade itself are observed and the evaluation is performed with the following evaluation criteria.

A: the photoreceptor contacting surface is observed by a laser microscope and no cracks are observed B: minute cracks generated, but not problematic for the image C: cracks generated, and image failure such as vertical bars occurred Blade Squeal Evaluation The test described above is performed by changing the process speed to 110 mm/sec and 55 mm/sec, the occurrence of squeal (noise) generated at the time of rubbing of the photoreceptor and the cleaning blade is checked, and the evaluation is performed with the following evaluation criteria.

A: only device driving sound

B: some blade squeal other than device driving sound

C: loud blade squeal and a level that anyone can determine as harsh noise

Abrasion Resistance Evaluation

The friction resistance of the cleaning blade is evaluated by the following method.

An image forming is performed by using A4-sized paper (210 mm×297 mm, P paper manufactured by Fuji Xerox Co., Ltd.) under the high temperature and high humidity environment (32.5° C., 85 RH %), until the revolution number of the photoreceptor becomes 100 K cycles. After that, the abrasion depth on the (edge) tip of the contacting portion of the cleaning blade and the cleaning failure are evaluated, and the edge abrasion is determined. At the time of the test, since the evaluation is performed in harsh conditions with the small lubricating effect of the contacting portion of the photoreceptor and the cleaning blade, the resolution of the formed image is set to 1%. In addition, the abrasion depth of the edge tip is measured as the maximum depth of the edge missing portion on the photoreceptor surface side, checked from the cross section side of the cleaning blade at the time of observation by a laser microscope VK-8510 manufactured by Keyence Corporation.

Further, in the evaluation of the cleaning failure, after completing the test described above, the A3-sized paper on which a non-transfer solid image having image density of 100% (solid image size: 1400 mm×290 mm) is fed between the photoreceptor and the cleaning blade at a normal process speed, the apparatus is stopped immediately after the final end portion of the non-fixed image in the transportation direction is passed through the contacting portion of the photoreceptor and the cleaning blade, and the slipping of the toner is visually checked. The case where the significant slipping is observed is determined as the cleaning failure. In addition, in a case where the portion for stopping the toner is missed by the abrasion or cracks on the edge tip, since the cleaning failure occurs more easily in the test described above as the edge abrasion depth or the crack depth is larger, the test is useful for the qualitative evaluation of the abrasion or cracks on the edge tip.

The evaluation criteria of the edge abrasion are shown below. In addition the allowable range is A and B.

A: Abrasion depth of tip portion: equal to or less than 3 μm and no abrasion mark Cleaning failure: not occurred B: Abrasion depth of tip portion: more than 3 μm and equal to or less than 5 μm Cleaning failure: not occurred C: Abrasion depth of tip portion; more than 5 μm Cleaning failure; occurred Image Quality Evaluation The obtained cleaning blades of Examples and Comparative Examples are mounted as cleaning blades for the photoreceptor drum of a color copier (DocuCentre Color a450 manufactured by Fuji Xerox Co., Ltd.).

The image forming of an image having the image density of 1% (solid image of 6.2 mm×1 mm on the A4-sized sheet) is repeated 2,000 times on the sheets (C2r sheet manufactured by Fuji Xerox Co., Ltd.). The deformation degree of the cleaning blade after the image forming, and the occurrence state of the image quality failure of the color streak are visually evaluated by the following criteria.

A: color streak is not checked

B: few color streaks are checked on an image but in the allowable range

C: color streak is checked on an image and not allowable.

TABLE 1

| | | Ex. 1 | Ex. 2 | Ex. 3 | Ex. 4 | Ex. 5 | Ex. 6 | Ex. 7 | Ex. 8 | Ex. 9 | Com. Ex. 1 |
|---|---|---|---|---|---|---|---|---|---|---|---|
| Endothermic peak temperature on high temperature side [° C.] | | 200 | 180 | 220 | 220 | 200 | 220 | 170 | 225 | 225 | 190 |
| Endothermic peak temperature on low temperature side [° C.] | | 140 | 120 | 120 | 160 | 100 | 170 | 140 | 140 | 100 | — |
| Average particle size on high melting point side [μm] | | 10 | 5 | 20 | 20 | 10 | 20 | 2 | 25 | 25 | 6 |
| Average particle size on low melting point side [μm] | | 0.15 | 0.1 | 0.1 | 0.5 | 0.05 | 2 | 0.15 | 0.15 | 0.05 | — |
| Hardness (JIS-A) | | 85 | 80 | 85 | 90 | 70 | 95 | 75 | 93 | 90 | 80 |
| Modulus | | 7.5 | 8.3 | 9 | 6.3 | 10 | 5.9 | 7.1 | 8 | 10 | 4.5 |
| Evaluation | Blade damage | A | A | A | B | A | B | A | B | B | C |
| | Blade squeal | A | B | A | A | B | B | B | A | B | C |
| | Abrasion resistance | A | A | A | B | A | B | A | A | A | C |
| | Image quality | A | B | A | B | B | B | B | B | A | C |

The endothermic peak temperature (T1) on a high temperature side is in a range of 180° C. to 220° C. and the endothermic peak temperature (T2) on a low temperature side is in a range of 120° C. to 160° C. in Examples 1 and 3, and accordingly, it is considered that cleaning blades in which the hard segment aggregates (crystal portions) having a small particle size have high strength since the surface area joined with the soft segment is large, and the hard segment aggregates (crystal portion) having a large particle size have excellent image performance since the sliding property is given, are obtained.

The endothermic peak temperature (T2) on a low temperature side is low in a range of 120° C. to 160° C. and the hardness is also low in Example 2, and accordingly, it is considered that the blade squeal of Example 2 occurs more severely than that of Example 1, however, it is a level with no practical problem.

The endothermic peak temperature (T2) on a low temperature side is high in a range of 120° C. to 160° C. in Example 4, and thus, it is considered that strength of the surface area joined with the soft segment of Example 4 is small and the strength is slightly degraded, compared to Example 1, however, it is a level with no practical problem.

In Example 5, the endothermic peak temperature (T2) on a low temperature side is lower than 120° C., the crystal particles (hard segment aggregates) on a low melting point side are not sufficiently grown on the blade surface, the sliding property is degraded, and accordingly, slight blade squeal occurs, however, it is a level with no practical problem.

In Example 6, the endothermic peak temperature (T2) on a low temperature side exceeds 160° C., the compatibility with the soft segment is decreased due to decrease of a specific surface area of the crystal particles (hard segment aggregates) on a low melting side, and the mechanical strength such as modulus and tensile strength, and the like is degraded, and accordingly, the blade damage is worsened. In addition, since the crystal portion area on the blade is small, the sliding property is degraded and the blade squeal also slightly occurs, however, it is a level with no practical problem.

In Example 7, the endothermic peak temperature (T1) on a high temperature side is less than 180° C., and the particle size of the crystal sphere on a high melting point side is small, and accordingly, the sliding property is slightly degraded, however, it is a level with no practical problem.

In Example 8, the endothermic peak temperature (T1) on a high temperature side exceeds 220° C., and the crystals on a high melting point side are excessively grown, and accordingly, the elasticity is lost and the blade becomes slightly brittle, and thus, the blade damage is worsened, however, it is a level with no practical problem.

In Example 9, the endothermic peak temperature (T1) on a high temperature side exceeds 220° C. and the crystals on a high melting point side are excessively grown, and accordingly, the elasticity is lost and the blade becomes slightly brittle, and thus, the blade damage is worsened. In addition, the endothermic peak temperature (T2) on a low temperature side is less than 120° C., the crystal particles (hard segment aggregates) on a low melting point side are not sufficiently grown on the blade surface, and the sliding property is degraded, and accordingly the blade squeal slightly occurs, however, it is a level with no practical problem.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning blade comprising a contact portion that contacts a member to be cleaned, wherein the contact portion at least contains polyurethane rubber and has at least two different endothermic peak temperatures by differential scanning calorimetry in a range of 100° C. or higher.

2. The cleaning blade according to claim 1, wherein, in the two different endothermic peak temperatures, an endothermic peak temperature (T1) on a high temperature side is in a range of 180° C. to 220° C., and an endothermic peak temperature (T2) on a low temperature side is in a range of 120° C. to 160° C.

3. The cleaning blade according to claim 2, wherein, in the two different endothermic peak temperatures, the endothermic peak temperature (T1) on a high temperature side is in a range of 185° C. to 215° C.

4. The cleaning blade according to claim 2, wherein, in the two different endothermic peak temperatures, the endothermic peak temperature (T1) on a high temperature side is in a range of 190° C. to 210° C.

5. The cleaning blade according to claim 2, wherein, in the two different endothermic peak temperatures, the endothermic peak temperature (T2) on a low temperature side is in a range of 120° C. to 140° C.

6. The cleaning blade according to claim 2, wherein, in the two different endothermic peak temperatures, the endothermic peak temperature (T2) on a low temperature side is in a range of 120° C. to 130° C.

7. The cleaning blade according to claim 1, wherein the polyurethane rubber includes hard segments and soft segments.

8. The cleaning blade according to claim 7, wherein hard segment aggregates on a high melting point side and hard segment aggregates on a low melting point side are mixed in the hard segments.

9. The cleaning blade according to claim 8, wherein an average particle size of the hard segment aggregates on a high melting point side is from 5 μm to 20 μm.

10. The cleaning blade according to claim 8, wherein an average particle size of the hard segment aggregates on a high melting point side is from 5 μm to 15 μm.

11. The cleaning blade according to claim 8, wherein an average particle size of the hard segment aggregates on a high melting point side is from 5 μm to 10 μm.

12. The cleaning blade according to claim 8, wherein an average particle size of the hard segment aggregates on a low melting point side is from 0.10 μm to 0.50 μm.

13. The cleaning blade according to claim 8, wherein an average particle size of the hard segment aggregates on a low melting point side is from 0.10 μm to 0.30 μm.

14. The cleaning blade according to claim 8, wherein an average particle size of the hard segment aggregates on a low melting point side is from 0.10 μm to 0.20 μm.

15. A cleaning device comprising the cleaning blade according to claim 1.

16. A process cartridge comprising the cleaning device according to claim 15, wherein the process cartridge is detachable from an image forming apparatus.

17. An image forming apparatus comprising;

an image holding member;

a charging device that charges the image holding member;

an electrostatic latent image forming device that forms an electrostatic latent image on a surface of a charged image holding member;

a developing device that develops the electrostatic latent image formed on the surface of the image holding member with toner to form a toner image;

a transfer device that transfers the toner image formed on the image holding member on a recording medium; and the cleaning device according to claim 15 that brings the cleaning blade into contact with the surface of the image holding member after the transfer of the toner image by the transfer device for cleaning.

* * * * *